US008450940B2

(12) United States Patent
Wang et al.

(10) Patent No.: US 8,450,940 B2
(45) Date of Patent: May 28, 2013

(54) GAS-DISCHARGE LAMP CONTROLLER UTILIZING A NOVEL PREHEATING PHASE CONTROL MECHANISM

(75) Inventors: Yen-Ping Wang, Taipei (TW); Pei-Yuan Chen, Taipei County (TW); Ko-Ming Lin, Tainan (TW)

(73) Assignee: Grenergy Opto Inc., Hsin-chu (TW)

( * ) Notice: Subject to any disclaimer, the term of this patent is extended or adjusted under 35 U.S.C. 154(b) by 448 days.

(21) Appl. No.: 12/784,039

(22) Filed: May 20, 2010

(65) Prior Publication Data

US 2011/0285322 A1 Nov. 24, 2011

(51) Int. Cl.
*H05B 37/02* (2006.01)

(52) U.S. Cl.
USPC ..... 315/291; 315/224; 315/307

(58) Field of Classification Search
USPC ..... 315/224, 246, 307, 209 R, 291
See application file for complete search history.

(56) References Cited

U.S. PATENT DOCUMENTS

| | | | | |
|---|---|---|---|---|
| 5,699,238 | A * | 12/1997 | Lee et al. | 363/21.03 |
| 5,872,429 | A * | 2/1999 | Xia et al. | 315/194 |
| 2002/0125834 | A1* | 9/2002 | Shoji et al. | 315/224 |
| 2003/0122506 | A1* | 7/2003 | Kamata et al. | 315/291 |

* cited by examiner

*Primary Examiner* — Jimmy Vu
*Assistant Examiner* — Henry Luong
(74) *Attorney, Agent, or Firm* — Muncy, Geissler, Olds & Lowe, PLLC

(57) ABSTRACT

A gas-discharge lamp controller utilizing a novel preheating phase control mechanism, having: a supply voltage tracking reference voltages generator, biased between a supply voltage and a reference ground, for generating a first reference voltage which is proportional to the supply voltage; and a control unit, for generating a high threshold signal according to the first reference voltage and a saw-tooth signal, the peak value of the saw-tooth signal being proportional to the supply voltage, wherein the control unit has a preheating phase, the high threshold signal is coupled with the first reference voltage during the preheating phase, and the time duration of the preheating phase is set by a predetermined number of periods of the saw-tooth signal.

9 Claims, 4 Drawing Sheets

GAS-DISCHARGE LAMP CONTROLLER UTILIZING A NOVEL PREHEATING PHASE CONTROL MECHANISM

BACKGROUND OF THE INVENTION

1. Field of the Invention

The present invention relates to gas-discharge lamp controllers, and more particularly to gas-discharge lamp controllers capable of providing preheating time setting for gas-discharge lamps.

2. Description of the Related Art

In supplying power to gas-discharge lamps, electronic ballasts are widely adopted to keep the lamp current stable.

To increase the lifetime of gas-discharge lamps, the electronic ballasts should start with a preheating phase to pre heat the lamps, enter an ignition phase after the preheating phase to ignite the lamps, and then settle to a steady phase. Of the three phases, the preheating phase is required to have a precise time duration to facilitate the ignition of the lamps and thereby prolong the lifetime of the lamps.

A prior art solution for controlling the time duration of the preheating phase is utilizing a current source inside a gas-discharge lamp controller to charge an external capacitor, and as the voltage on the external capacitor, increasing from a low voltage, reaches a reference voltage which is provided in the gas-discharge lamp controller and independent of the supply voltage of the gas-discharge lamp controller, the preheating phase is ended. Please refer to FIG. 1, which shows a block diagram of part of a ballast circuit, including a prior art gas-discharge lamp controller and an external capacitor. As can be seen in FIG. 1, the gas-discharge lamp controller 100, coupled with a capacitor 110, including a current source 101 and a comparator 102.

The current source 101, coupled to a supply voltage $V_{CC}$, is of small current and used to charge the capacitor 110 to generate a slowly increasing voltage $V_C$. The comparator 102 is used to compare the slowly increasing voltage $V_C$ with a reference voltage $V_{REF}$, the reference voltage $V_{REF}$ being independent of the supply voltage $V_{CC}$. As the slowly increasing voltage $V_C$ reaches the reference voltage $V_{REF}$, an output signal $S_{PHE}$ of the comparator 102 will change state from low to high to indicate the end of the preheating phase.

As a typical example, the time duration of the preheating phase is around 1 second. To minimize the production cost, the capacitance of the external capacitor 110 is required to be as small as possible, as such, the current source 101 has to be rated at a small current. However, the variance of this small current is tending to be large due to two causes—device variations and the supply voltage $V_{CC}$ variations. When it comes to a small current, the widths of the related MOSFETs have to be narrow, so the small current is very sensitive to device variations; and when the supply voltage $V_{CC}$ becomes higher/lower, the current source 101 is inclined to follow, which will make the time duration of the preheating phase shorter/longer. As such, this kind of design can not provide a fixed, precise preheating time for the gas-discharge lamps.

In view of the cons of the prior art design, the present invention proposes a novel topology of a gas-discharge lamp controller capable of providing a precise preheating time without adding any extra pin.

SUMMARY OF THE INVENTION

One objective of the present invention is to disclose a gas-discharge lamp controller utilizing a novel preheating phase control mechanism without adding any extra pin, capable of providing a precise preheating time setting for gas-discharge lamps irrespective of supply voltage variations.

Another objective of the present invention is to disclose a gas-discharge lamp controller utilizing a novel preheating phase control mechanism without adding any extra pin, capable of providing a precise preheating time setting for gas-discharge lamps irrespective of device variations.

Still another objective of the present invention is to provide a gas-discharge lamp controller utilizing a novel preheating phase control mechanism without adding any extra pin, capable of providing a precise preheating time setting and a precise ignition time setting for gas-discharge lamps by utilizing a saw-tooth signal, of which the time constant of the exponentially rising portion is determined by an external series resistor-capacitor network; and two reference voltages, which tracks a supply voltage.

To achieve the foregoing objectives, the present invention provides a gas-discharge lamp controller utilizing a novel preheating phase control mechanism, having: a supply voltage tracking reference voltages generator, biased between a supply voltage and a reference ground, for generating a first reference voltage which is proportional to the supply voltage; and a control unit, for generating a high threshold signal according to the first reference voltage and a saw-tooth signal, the peak value of the saw-tooth signal being proportional to the supply voltage, wherein the control unit has a preheating phase, the high threshold signal is coupled with the first reference voltage during the preheating phase, and the time duration of the preheating phase is set by a predetermined number of periods of the saw-tooth signal.

To make it easier for our examiner to understand the objective of the invention, its structure, innovative features, and performance, we use a preferred embodiment together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 1:
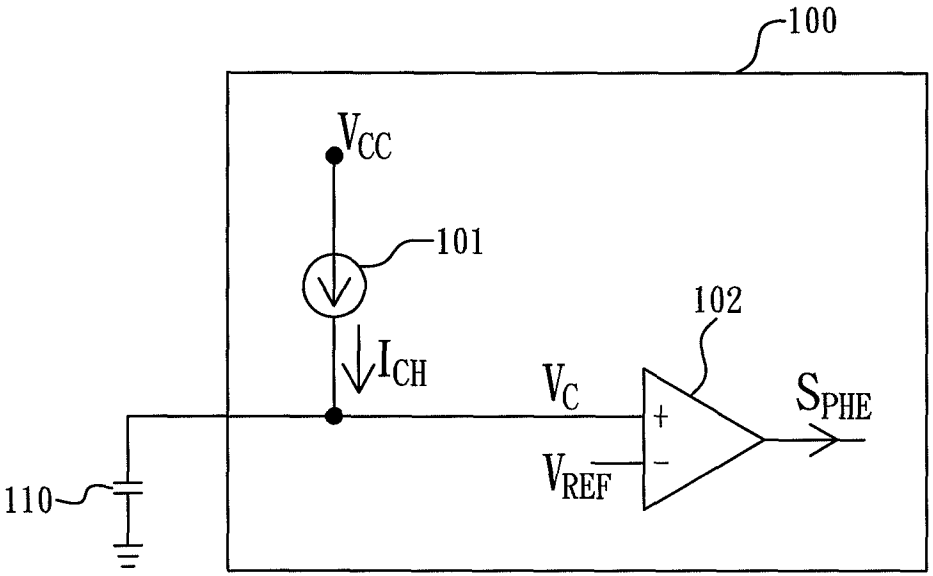
FIG. 1 (PRIOR ART)
FIG. 1 is a block diagram of part of a ballast circuit, including a prior art gas-discharge lamp controller and an external capacitor.
Figure 2:
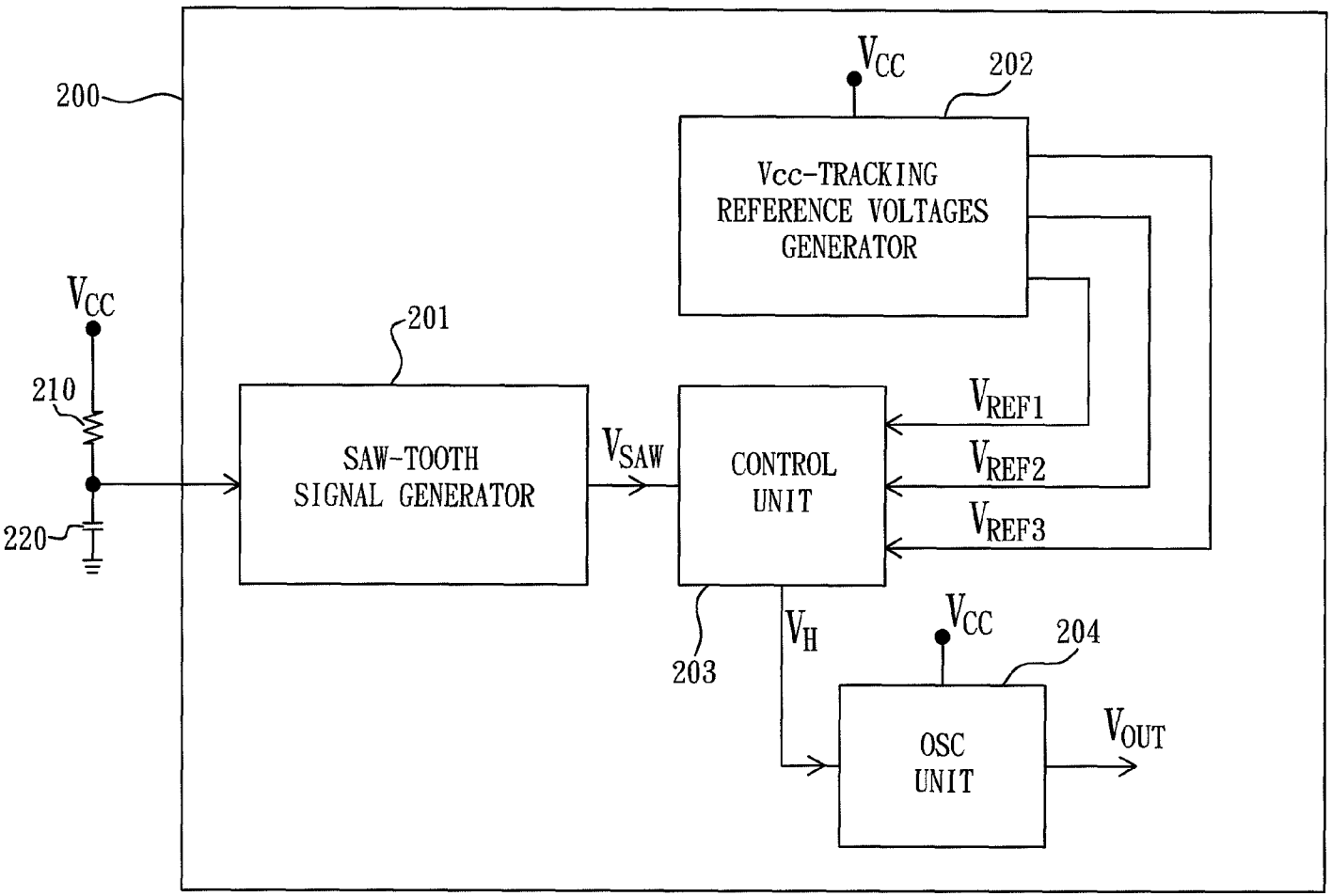
FIG. 2 is a block diagram of part of a ballast circuit, including a gas-discharge lamp controller according to a preferred embodiment of the present invention, an external resistor, and an external capacitor.

Please refer to FIG. 2, which shows a block diagram of part of a ballast circuit, including a gas-discharge lamp controller according to a preferred embodiment of the present invention, an external resistor, and an external capacitor. As shown in FIG. 2, the gas-discharge lamp controller 200, coupled with a resistor 210 and a capacitor 220, including a saw-tooth signal generator 201, a $V_{CC}$-tracking reference voltages generator 202, a control unit 203 and an OSC unit 204.

The saw-tooth signal generator 201 is coupled with the external series resistor-capacitor network—including the resistor 210 and the capacitor 220—to generate a saw-tooth signal $V_{SAW}$, and the saw-tooth signal generator 201 is preferably but not limited to an astable vibrator. The saw-tooth signal generator 201 has a high threshold voltage, proportional to the supply voltage $V_{CC}$, to determine the period of the saw-tooth signal $V_{SAW}$—each time the saw-tooth signal $V_{SAW}$ reaches the high threshold voltage, the saw-tooth signal generator 201 will pull it down to a reference ground, so the higher/lower the high threshold voltage, the longer/shorter the period.

Besides, as the high threshold voltage is proportional to the supply voltage $V_{CC}$, the resulted period is independent of the supply voltage $V_{CC}$. The proof is as below:

Suppose it takes a time duration of T for the saw-tooth signal $V_{SAW}=V_{CC}[1-\exp(-t/RC)]$ to reach the high threshold voltage $\alpha V_{CC}$, $0<\alpha<1$, then the time duration of T will be equal to $-RC\ln(1-\alpha)$, which is independent of the supply voltage $V_{CC}$.

For one design example, if the resistance of the resistor 210 and the capacitance of the capacitor 220 are 400 KΩ and 330 nF respectively, and the high threshold voltage is equal to $(2/3)V_{CC}$, then the resulted period of the saw-tooth signal $V_{SAW}$ is 145 msec. In this design example, seven periods of the saw-tooth signal $V_{SAW}$ will make a time duration of around 1.01 sec.

The $V_{CC}$-tracking reference voltages generator 202, preferably but not limited to a resistive network biased by the supply voltage $V_{CC}$, is used to generate a first reference voltage $V_{REF1}$, a second reference voltage $V_{REF2}$ and a third reference voltage $V_{REF3}$, with $V_{REF2}>V_{REF1}>V_{REF3}$, and the three reference voltages are proportional to the supply voltage $V_{CC}$.

Figure 3:
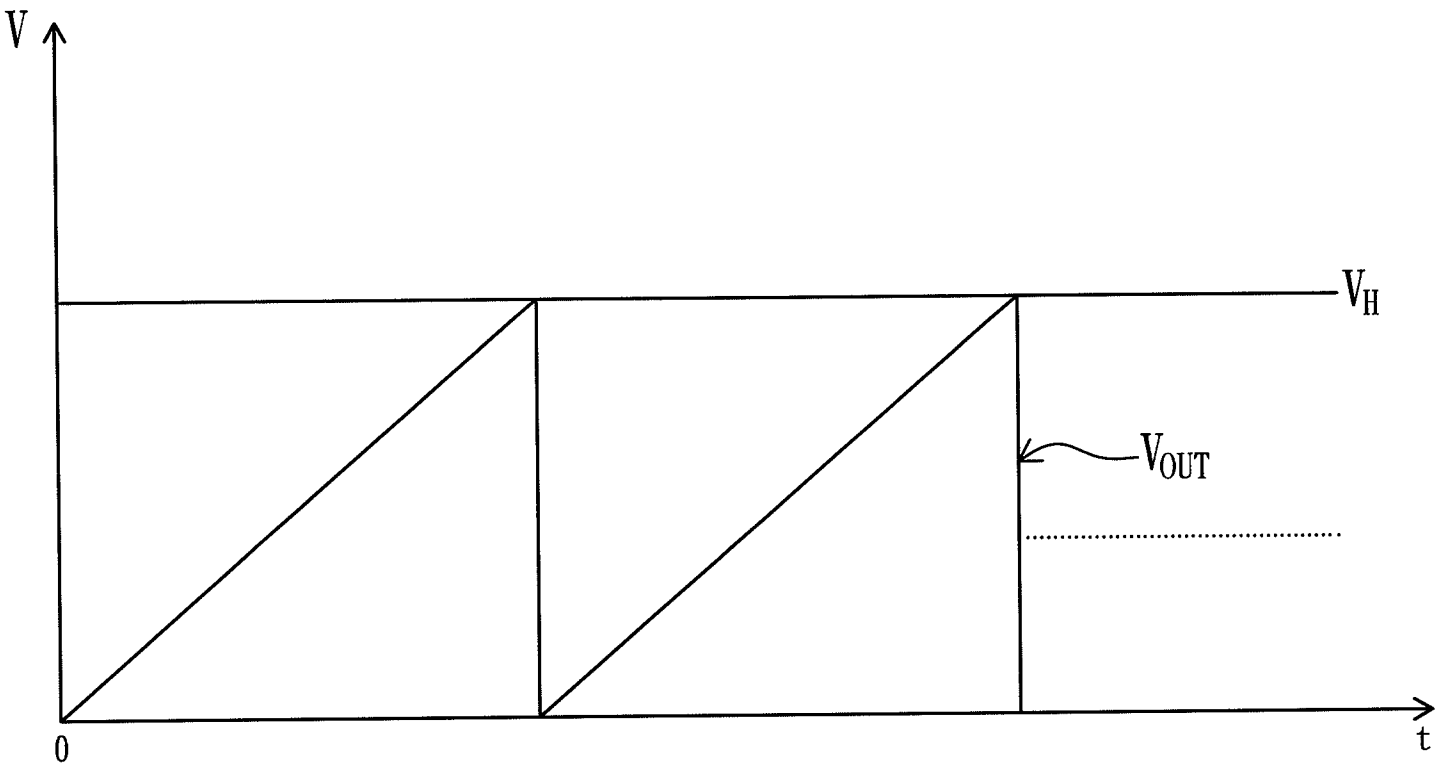
FIG. 3 is a waveform diagram showing the relation between a high threshold signal and an output signal in an oscillator (OSC) unit of the gas-discharge lamp controller in FIG. 2.

The control unit 203 is used for generating a high threshold signal $V_H$ according to the saw-tooth signal $V_{SAW}$, the first reference voltage $V_{REF1}$, the second reference voltage $V_{REF2}$ and the third reference voltage $V_{REF3}$, and the OSC unit 204, preferably but not limited to an astable vibrator, is used to generate an oscillation signal $V_{OUT}$ of which the period is determined by the high threshold signal $V_H$. Please refer to FIG. 3, which shows a waveform diagram indicating the relation between the high threshold signal $V_H$ and the oscillation signal $V_{OUT}$. As can be seen in FIG. 3, the period of the oscillation signal $V_{OUT}$ is set by the high threshold signal $V_H$ so that the oscillation frequency of the oscillation signal $V_{OUT}$ will be increased (decreased) as the voltage of the high threshold signal $V_H$ is decreased (increased). When the oscillation frequency of the oscillation signal $V_{OUT}$ is increased, there will be less power delivered to the gas-discharge lamp, and when the oscillation frequency of the oscillation signal $V_{OUT}$ is decreased, there will be more power delivered to the gas-discharge lamp. To prolong the lifetime of the gas-discharge lamp, the oscillation frequency of the oscillation signal $V_{OUT}$ should be initially at a high value and then decreased gradually during the following preheating phase, the ignition phase and the steady phase, to have the power delivered to the gas-discharge lamp be gradually increasing from a low value to a higher steady one.

Figure 4:
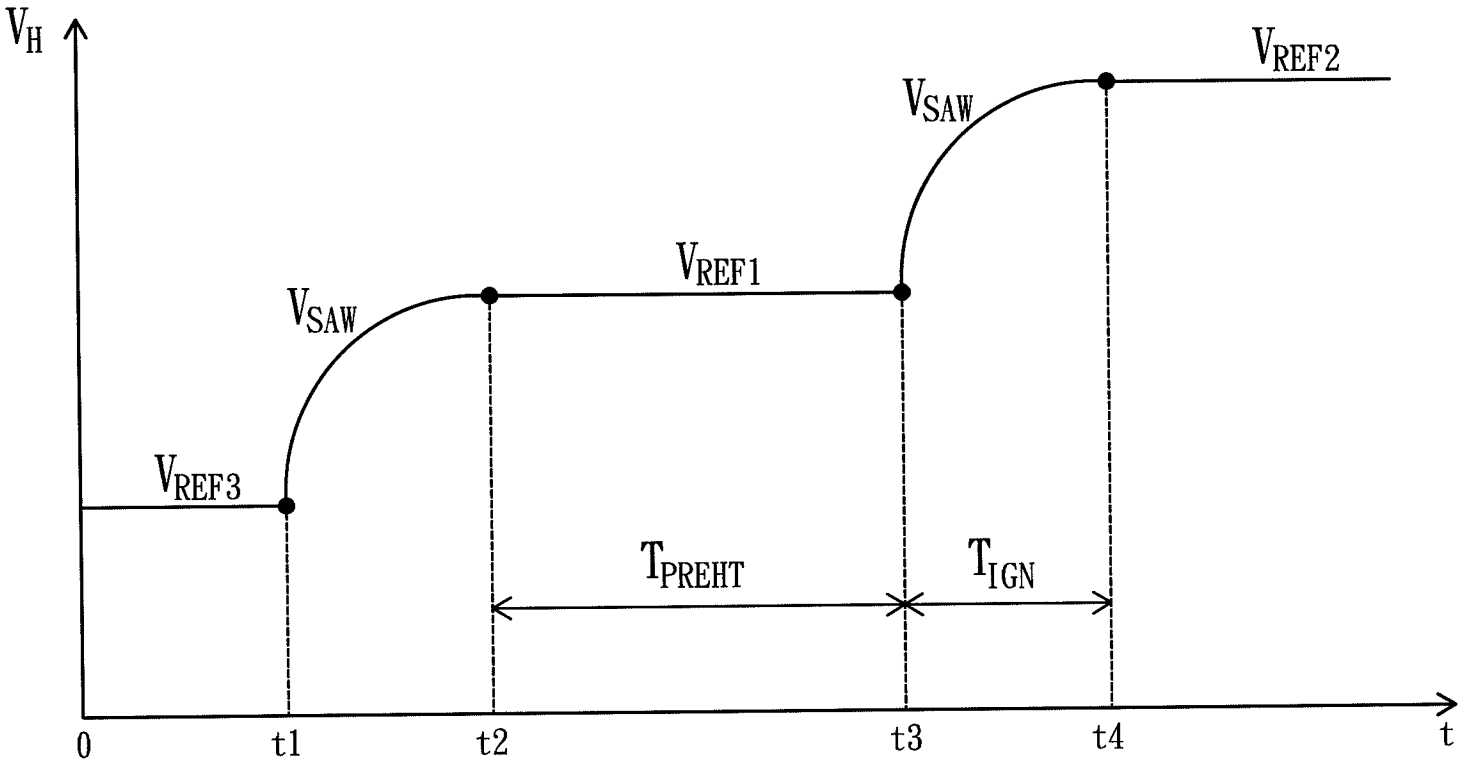
FIG. 4 is a waveform diagram showing different phases of the high threshold signal in the OSC unit of the gas-discharge lamp controller in FIG. 2.

Please refer to FIG. 4, which shows a waveform diagram indicating different phases of the high threshold signal $V_H$ in the lighting of the gas-discharge lamp according to a preferred embodiment of the present invention. During t=0~t1, the high threshold signal $V_H$ is coupled with the third reference voltage $V_{REF3}$ to generate an initial oscillation frequency, for example but not limited to 100 $KH_Z$, wherein t1 is the instant when the saw-tooth signal $V_{SAW}$ reaches the third reference voltage $V_{REF3}$.

During t=t1~t2, the high threshold signal $V_H$ is coupled with the saw-tooth signal $V_{SAW}$ to gradually decrease the oscillation frequency, wherein t2 is the instant when the saw-tooth signal $V_{SAW}$ reaches the first reference voltage $V_{REF1}$.

During t=t2~t3, a preheating time $T_{PREHT}$=t3−t2, the high threshold signal $V_H$ is coupled with the first reference voltage $V_{REF1}$ to generate an oscillation frequency, for example but not limited to 66 $KH_Z$, wherein t3 is the instant when the saw-tooth signal $V_{SAW}$ starts to issue its $8^{th}$ period with the beginning of its first period at the instant t2. As mentioned in the previous specification, the preheating time $T_{PREHT}$ is around 1.01 sec and independent of the supply voltage $V_{CC}$. Besides, since the preheating time $T_{PREHT}$ is determined by the external RC time constant and a resistive ratio—corresponding to $(2/3)V_{CC}/V_{CC}=2/3$, it is also insensitive to the device variations of the controller chip.

During t=t3~t4, an ignition time $T_{IGN}$=t4−t3, the high threshold signal $V_H$ is coupled with the saw-tooth signal $V_{SAW}$ to gradually decrease the oscillation frequency, wherein t4 is the instant when the saw-tooth signal $V_{SAW}$ reaches the second reference voltage $V_{REF2}$. As proven in the previous specification, the ignition time $T_{IGN}$=t4−t3 is a fixed value—for example but not limited to 100 msec—and independent of the supply voltage $V_{CC}$, since the first reference voltage $V_{REF1}$, the peak value of the saw-tooth signal $V_{SAW}$ and the second reference voltage $V_{REF2}$, are all proportional to the supply voltage $V_{CC}$. Besides, as the ignition time $T_{IGN}$ is determined by the external RC time constant and two resistive ratios—corresponding to $V_{REF1}/V_{CC}$ and $V_{REF2}/V_{CC}$, it is also insensitive to the device variations of the controller chip.

After t4, the steady state, the high threshold signal $V_H$ is coupled with the second reference voltage $V_{REF2}$ to generate an oscillation frequency, for example but not limited to 46 $KH_Z$.

According to the description above, the present invention—utilizing a saw-tooth signal $V_{SAW}=V_{CC}(1-\mathrm{EXP}(-t/RC))$ and $V_{CC}$-tracking reference voltages: $V_{REF1}=\alpha_1 V_{CC}$, $V_{REF2}=\alpha_2 V_{CC}$, $V_{REF3}=\alpha_3 V_{CC}$—can provide an appropriate oscillation frequency profile with precise time durations for the whole lighting process, especially for the preheating phase and the ignition phase. What is more, the switching of the high threshold signal from a reference voltage to the saw-tooth signal offers a precise gradually decreasing effect in oscillation frequency, which is beneficial to the lifetime of the gas-discharge lamps.

In conclusion, the present invention proposes a gas-discharge lamp controller utilizing a novel control mechanism for preheating phase and ignition phase, capable of providing a precise preheating time and a precise ignition time which are independent of the supply voltage variations and insensitive to the device variations, without adding any extra pin on the controller, so the present invention does conquer the disadvantages of the prior art design.

While the invention has been described by way of examples and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures. For example, implementing the saw-tooth signal generator 201 outside the gas-discharge lamp controller 200, or replacing the saw-tooth signal generator 201 with any waveform generator—digital or analog or the combination of digital and analog—that can generate a waveform similar to $V_{SAW}=V_{CC}(1-EXP(-t/RC))$, should be deemed within the scope of the present invention.

In summation of the above description, the present invention herein enhances the performance than the conventional structure and further complies with the patent application requirements and is submitted to the Patent and Trademark Office for review and granting of the commensurate patent rights.

What is claimed is:

1. A gas-discharge lamp controller utilizing a novel preheating phase control mechanism, comprising:

a supply voltage tracking reference voltages generator, biased between a supply voltage and a reference ground, for generating a first reference voltage which is proportional to said supply voltage; and a control unit, for generating a high threshold signal according to said first reference voltage and a saw-tooth signal, a peak value of said saw-tooth signal being proportional to said supply voltage, wherein said control unit has a preheating phase, said high threshold signal is coupled with said first reference voltage during said preheating phase, and the time duration of said preheating phase is set by a predetermined number of periods of said saw-tooth signal;

wherein said supply voltage tracking reference voltages generator further generates a second reference voltage, which is proportional to said supply voltage and coupled to said control unit; and wherein said control unit further has an ignition phase after said preheating phase, said high threshold signal is coupled with said saw-tooth signal during said ignition phase, and the end of said ignition phase is determined when said saw-tooth signal reaches said second reference voltage.

2. The gas-discharge lamp controller utilizing a novel preheating phase control mechanism as claim 1, further comprising a saw-tooth signal generator, coupled to an external series resistor-capacitor network which is biased between said supply voltage and said reference ground, to generate said saw-tooth signal.

3. The gas-discharge lamp controller utilizing a novel preheating phase control mechanism as claim 2, further comprising an oscillator (OSC) unit for generating an oscillation signal of which the period is determined by said high threshold signal.

4. A gas-discharge lamp controller utilizing a novel preheating phase control mechanism, comprising:

a supply voltage tracking reference voltages generator, biased between a supply voltage and a reference ground, for generating a first reference voltage and a second reference voltage which are proportional to said supply voltage; and a control unit, generating a high threshold signal according to said first reference voltage, said second reference voltage and a saw-tooth signal, a peak value of said saw-tooth signal being proportional to said supply voltage, wherein said high threshold signal is initially at said first reference voltage, then switched to said saw-tooth signal after a predetermined number of periods of said saw-tooth signal, and changed to said second reference voltage when said saw-tooth signal reaches said second reference voltage.

5. The gas-discharge lamp controller utilizing a novel preheating phase control mechanism as claim 4, further comprising a saw-tooth signal generator, coupled to an external series resistor-capacitor network which is biased between said supply voltage and said reference ground, to generate said saw-tooth signal.

6. The gas-discharge lamp controller utilizing a novel preheating phase control mechanism as claim 5, further comprising an OSC unit for generating an oscillation signal of which the period is determined by said high threshold signal.

7. The gas-discharge lamp controller utilizing a novel preheating phase control mechanism as claim 4, wherein said supply voltage tracking reference voltages generator comprises a resistive network.

8. The gas-discharge lamp controller utilizing a novel preheating phase control mechanism as claim 6, wherein said OSC unit comprises an astable vibrator.

9. A gas-discharge lamp controller utilizing a novel preheating phase control mechanism, coupled with an external series resistor-capacitor network, wherein said external series resistor-capacitor network is biased between a supply voltage and a reference ground, said gas-discharge lamp controller comprising:

a saw-tooth signal generator, coupled to said external series resistor-capacitor network to generate a saw-tooth signal;

a supply voltage tracking reference voltages generator, biased between said supply voltage and said reference ground, for generating a first reference voltage, a second reference voltage and a third reference voltage which are proportional to said supply voltage; and a control unit, generating a high threshold signal according to said saw-tooth signal, said first reference voltage, said second reference voltage and said third reference voltage, wherein said high threshold signal is initially at said third reference voltage, then changed to said saw-tooth signal when said saw-tooth signal reaches said third reference voltage, then switched to said first reference voltage when said saw-tooth signal reaches said first reference voltage, then switched to said saw-tooth signal after a predetermined number of periods of said saw-tooth signal, and changed to said second reference voltage when said saw-tooth signal reaches said second reference voltage.

* * * * *